United States Patent [19]

Kennon

[11] Patent Number: 4,474,029

[45] Date of Patent: Oct. 2, 1984

[54] HOT GAS DEFROST PAN AND SYSTEM

[75] Inventor: Frank K. Kennon, Owatonna, Minn.

[73] Assignee: King Company, Owatonna, Minn.

[21] Appl. No.: 382,149

[22] Filed: May 26, 1982

[51] Int. Cl.[3] ..... F25B 47/00

[52] U.S. Cl. ..... 62/278; 62/281; 62/513; 62/275

[58] Field of Search ..... 62/274, 275, 278, 80, 62/272, 150, 151, 234, 140, 277, 279, 281, 513; 165/171, 172, 174

[56] References Cited

U.S. PATENT DOCUMENTS

| | | | |
|---|---|---|---|
| 2,174,776 | 10/1939 | Buchanan . | |
| 2,526,032 | 10/1950 | LaPorte . | |
| 2,647,375 | 8/1953 | Zearfoss, Jr. . | |
| 2,672,023 | 3/1954 | Jacobs et al. . | |
| 2,672,025 | 3/1954 | Schweller . | |
| 2,735,279 | 2/1956 | Williams, Jr. | 62/276 X |
| 2,805,555 | 9/1957 | Schumacher . | |
| 3,213,637 | 10/1965 | Halls . | |
| 3,376,406 | 4/1968 | Phelps . | |
| 3,664,150 | 5/1972 | Patterson . | |
| 4,294,081 | 10/1981 | Mitani et al. . | |

*Primary Examiner*—Albert J. Makay
*Assistant Examiner*—Henry Bennett
*Attorney, Agent, or Firm*—Orrin M. Haugen; Thomas J. Nikolai; Douglas L. Tschida

[57] ABSTRACT

In a refrigeration system including a refrigerating coil, for circulating refrigerant to cool the space ambient thereto, and a defrost pan beneath the coil having a liquid drain outlet so that ice formed thereon by water condensing from the space drops therefrom to the pan, the improvement which comprises a heater pad mounted in the defrost pan to receive ice dropping from the coil, the heater pad comprising a generally flat array of laterally spaced elongated members of good heat conductivity having flat lower surfaces in contact with the defrost pan and flat upper surfaces jointly defining a longitudinally slotted substantially continuous ice receiving plane, the surfaces being in heat conductive relation with central fluid conducting bores, and the pad further comprising conduits for conducting heated fluid to and from the bores in a desired flow pattern to supply heat for conduction to the surfaces.

7 Claims, 3 Drawing Figures

HOT GAS DEFROST PAN AND SYSTEM

TECHNICAL FIELD

This invention relates to the field of refrigeration, and particularly to an apparatus and a system for facilitating and speeding up the defrosting of such systems.

BACKGROUND OF THE INVENTION

In large refrigeration systems it is the practice to defrost the refrigeration coils regurlarly to remove the ice formed thereon by condensation of water from the ambient atmosphere, since ice on the coils act as a heat insulator to reduce the efficiency of the system. During defrosting water and pieces of ice drop from the refrigeration coils, and it is preferred practice to position a defrost pan beneath the coils to receive the water and discharge it appropriately. Since such pans are customarily in position continuously, they become cold during the refrigeration cycle so that material falling on them would ordinarily freeze there rather than discharge as a liquid, the custom has developed of supplying heat to the pans at the same time of defrosting. This is usually done by circulating hot gas from the refrigeration compressor through conduits in heat conductive relation to the pan, with the intent that the pans will become warm enough, in the interval during which the coils themselves are being warmed, to avoid freezing the falling material.

The pan conduits have heretofore been patterns of tubing engaging the outer surface, or the inner surface, of the steel pan. With this arrangement, it is very difficult to achieve sufficent heat conductivity between the round tubing and the flat pan to enable adequate heat transfer to the pan within the constraints of time and available heat.

It is also known to form the pan material itself to furnish passages for hot gas lobe between two sections of steel welded together, one section forming the bottom of the pan itself. This arrangement is commonly referred to as a "waffle pan" construction, and is also quite expensive to manufacture.

BRIEF SUMMARY OF THE INVENTION

The present invention provides an improved defrost pan having a separate heater pad designed for greatly accelerated heat transfer to the pan, to ensure that water reaching the pan does not freeze, and also to directly receive falling pieces of ice and melt them so that only water engages the pan itself, the heat of fusion being supplied by the heater pad. This is accomplished by use of array of laterally spaced relatively thin elongated members of extended surface having flat lower surfaces in good thermal contact with the pan, and flat upper surfaces jointly defining a longitudinal slotted, substantially continuous ice receiving surface, together with means for conducting heater fluid to and from bores in the members in a desired heat flow path.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals indicate corresponding parts throughout the several views.

DESCRIPTION OF THE PREFERRED EMBODIMENT

Figure 1:
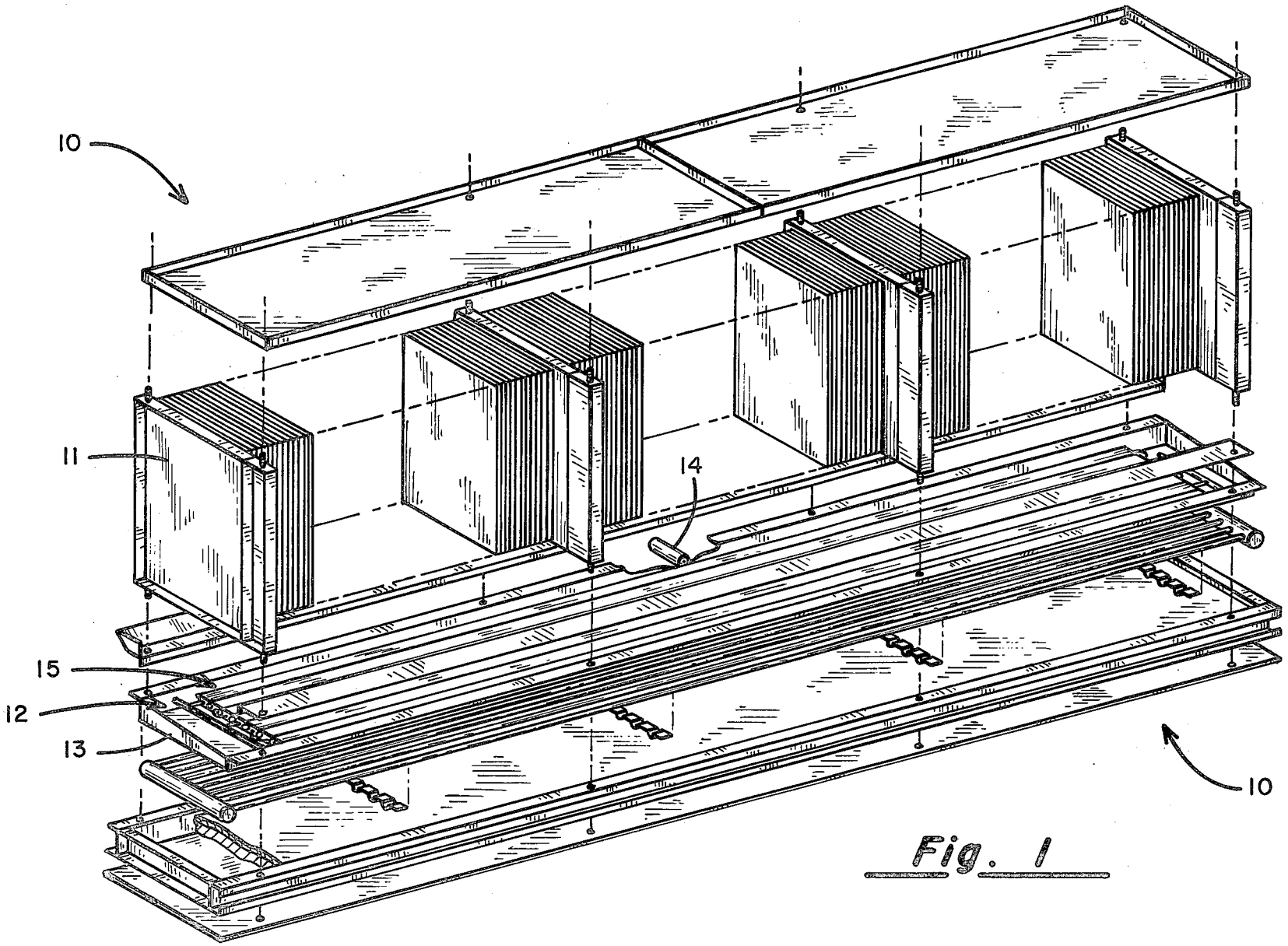
FIG. 1 is a schematic showing in perspective of a refrigeration system embodying the invention.
Figure 2:
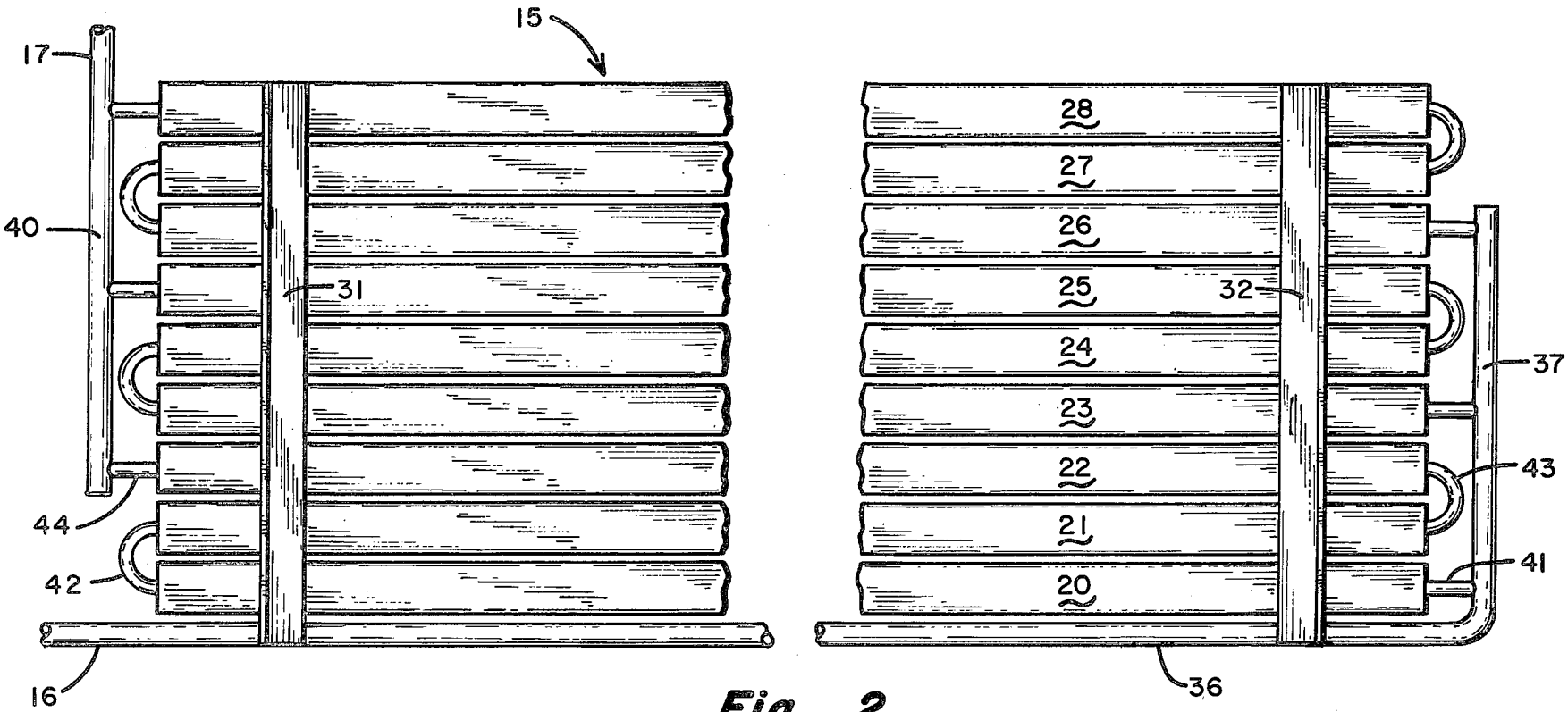
FIG. 2 is a plan view of a heater pad used in the practice of the invention.

As shown in FIG. 1, a refrigeration system according to the invention includes a unit 10 adapted for suspension from the ceiling of a space to be refrigerated. A multi-section refrigerator coil 11 receives refrigerant in conventional fashion from a compressor not shown, and the refrigerant is returned to the compressor for recirculation. A defrost pan 12 is mounted below the coil. It has a flat bottom 13 which slopes laterally, to direct liquid collecting therein to a drain 14. Positioned in pan 12 in good thermal contact with bottom 13 is a heater pad identified generally by numeral 15, having inlet and outlet connections 16 and 17, all as shown in FIG. 2.

Figure 3:
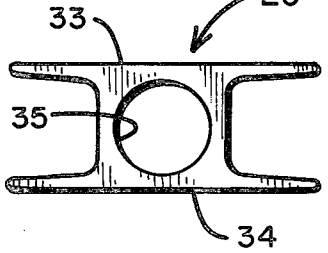
FIG. 3 is a view in transverse section of a heat transfer member of FIG. 2.

Pad 15 comprises a plurality of heat exchange members 20–28 inclusive, nine members being shown in the drawing although the exact number will of course depend upon the size of the installation. The members are assembled into an array by cross members 31 and 32 welded thereto, so that the members are mutually spaced by slight amounts. While the members may be made in various forms and of various materials, one satisfactory member has been extruded from aluminum, with a cross-sectional shape shown in FIG. 3. The members are seen to have a flat upper surface 33, a flat lower surface 34, and a central bore or lumen 35. It is considerably thinner than it is wide to provide large flat areas in good heat conductive relation to the central bore 35, and to obtain extended surfaces for the cross-sectional area involved.

Turning again to FIG. 2, it is evident that inlet 16 is connected by a tube 36 to an inlet header 37 connected to first ends of members 20, 23 and 26. Similarly, outlet 17 is connected to outlet header 40, which connects to ends of members 22, 25, and 28 remote from the inlet header. Bends 43 of 180° are provided to complete three flow patterns each including two bends and three members. Thus one pattern may be traced from inlet 16 through tube 36, header 37, a tube 41, member 20, bend 43, member 21, bend 43, member 22, and a tube 44 to outlet header 40.

Because of the flat surfaces 34, good thermal contact between members 20–28 and pan bottom 13 is easily obtained. The upper surfaces 33 jointly define a longitudinally slotted, substantially continuous plane which is positioned to receive pieces of ice falling from coil 11 and supply the heat required to melt them, without direct contact with pan bottom 13 or any liquid contained therein.

The piping interconnections by which cooling refrigerant and hot gas are supplied to the coils and heating pad are standard and form no part of the present invention, so that they are not detailed in the drawing.

OPERATION

System operation is as follows. In the refrigeration cycle, refrigerant is supplied to coils 11 and the air in the space being cooled is circulated over the coils by gravity or by the usual circulation fans, to cool the air and, hence, the contents of the space, including pan 12 and members 20–28 of heater pad 13.

When it is desired to defrost the apparatus, hot gas is supplied instead of cooled refrigerant to coils 11 and also to members 20–28 through the patterns traced above. By reason of the good conductivity of the material comprising members 20–28, e.g., aluminum, heat is transmitted rapidly from the hot gas flowing through bores 35 to the surfaces 33 and 34, to raise the temperature of those surfaces above the freezing point of water. The intimate contact and large contact area between surfaces 34 and bottom 13 also raise the temperature of the pan.

As defrosting progresses, water falls from coils 11 to pad 13, for the most part falling on upper surfaces 33 and being partially warmed as it flows through the spaces between the members. Pieces of ice of various sizes also fall from coils 11, land on upper surface 33, and melt there, further avoiding adverse cooling of pan bottom 13. Hence, water in pan 12, whether falling directly there from the coils or resulting from the melting ice on the surfaces 33, flows to drain 14 and discharges.

At the end of the defrosting cycle the flow of hot gas is cut off, and the normal refrigeration cycle is resumed.

From the above it will be evident that the invention comprises a new and more heat-efficient apparatus and system for use in defrosting refrigeration systems, including a heater pad designed for improved thermal engagement with a defroster pan and for directly receiving and melting pieces of ice falling during the defrosting process, without letting them fall to the bottom of the defrost pan and the liquid contained therein.

Numerous characteristics and advantages of the invention have been set forth in the foregoing description, together with details of the structure and the function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

I claim:

1. In a refrigeration system including a refrigerating coil, means for circulating refrigerant in said coil to cool the space ambient thereto, a defrost pan beneath said coil having a liquid drain outlet, and means for defrosting said coil so that ice formed thereon by water condensing from said space drops therefrom to said pan, the improvement which comprises a heater pad mounted in said defrost pan to receive ice dropping from said coil, said heater pad comprising a generally flat array of plural laterally spaced elongated members of good heat conductivity, said elongated members having flat lower surfaces in contact with said defrost pan and upper surfaces jointly defining a longitudinally slotted substantially continuous ice receiving area, said lower and upper surfaces being in heat conductive relation with central, fluid-conducting bores integrally formed in said members, and said pad further comprising means for conducting heated fluid to and from said bores in said members in a desired flow pattern to supply heat for conduction to said surfaces.

2. Apparatus according to claim 1 in which said upper surfaces are flat and said area is substantially plane.

3. A defrost pan comprising an elongated container and an elongated heater pad in said container;

said container having an open top, side and end walls, and a flat bottom sloping to a fluid discharge conduit; and said heater pad comprising a generally flat array of laterally spaced relatively thin elongated members of extended horizontal surface and a good heat conductivity, having flat, lower surfaces in thermal contact with said bottom of said drip pan, and upper surfaces jointly defining a longitudinally slotted, substantially planar area, said lower and upper surfaces being in heat conductive relation with central fluid conductive bores, integrally formed in each elongated member, and said pad further comprising means for conducting heated fluid to and from said bores in a desired flow pattern to supply heat for conduction to said surfaces.

4. A heater pad according to claim 3 in which the cross section of said elongated members is such as to maximize the areas of said surfaces for a given cross-sectional area of bore and of conductive material.

5. A heater pad according to claim 3 in which the width of said members is several times the thickness thereof.

6. A heater pad according to claim 3 in which the width of said surfaces is several times the diameter of said bores.

7. The heater pad as in claim 3 wherein said means for conducting heated fluid to and from said bores comprises a fluid inlet header in fluid communication with bores in predetermined ones of said elongated members; a fluid outlet header in fluid communication with bores in other predetermined ones of said elongated members and 180° tubular coupling members joining the ends of said bores on adjacent members not otherwise joined to either said inlet header or said outlet header.

* * * * *